US011501744B2

(12) United States Patent
Korfker

(10) Patent No.: US 11,501,744 B2
(45) Date of Patent: Nov. 15, 2022

(54) SHOULDER REST

(71) Applicant: Gustav Pirazzi & Comp. GmbH & Co. KG, Offenbach (DE)

(72) Inventor: Berent Korfker, London (GB)

(73) Assignee: Gustav Pirazzi & Comp. GmbH & Co. KG, Offenbach (DE)

( * ) Notice: Subject to any disclaimer, the term of this patent is extended or adjusted under 35 U.S.C. 154(b) by 0 days.

(21) Appl. No.: 17/323,555

(22) Filed: May 18, 2021

(65) Prior Publication Data

US 2021/0366444 A1 Nov. 25, 2021

(30) Foreign Application Priority Data

May 19, 2020 (EP) ..... 20175545.1

(51) Int. Cl.
*G10D 3/18* (2020.01)
*G10G 5/00* (2006.01)

(52) U.S. Cl.
CPC ..... *G10D 3/18* (2013.01); *G10G 5/005* (2013.01)

(58) Field of Classification Search
CPC ..... G10D 3/18; G10D 1/02; G10G 5/005
See application file for complete search history.

(56) References Cited

U.S. PATENT DOCUMENTS

| | | | | |
|---|---|---|---|---|
| 5,883,315 | A | 3/1999 | Kaplan et al. | |
| 8,704,065 | B2 * | 4/2014 | Korfker | G10D 3/18 84/280 |
| 2012/0011982 | A1 | 1/2012 | Johnson | |
| 2014/0090539 | A1 | 4/2014 | Korfker | |
| 2018/0005610 | A1 | 1/2018 | Bailey et al. | |

FOREIGN PATENT DOCUMENTS

| | | | |
|---|---|---|---|
| CH | 277350 | A | 8/1951 |
| DE | 3643225 | A1 | 7/1987 |
| GB | 871826 | A | 7/1961 |

* cited by examiner

*Primary Examiner* — Kimberly R Lockett
(74) *Attorney, Agent, or Firm* — Weitzman Law Offices, LLC

(57) ABSTRACT

A shoulder rest for a stringed instrument with a support element extending in a longitudinal direction for resting on the shoulder and/or chest of the player is intended to enable a particularly high tonal quality of the ensemble of instrument and shoulder rest. For this purpose, the support element is provided according to the invention with a number of opening slots extending in the longitudinal direction and completely penetrating the support element in its thickness.

14 Claims, 6 Drawing Sheets

FIG. 3
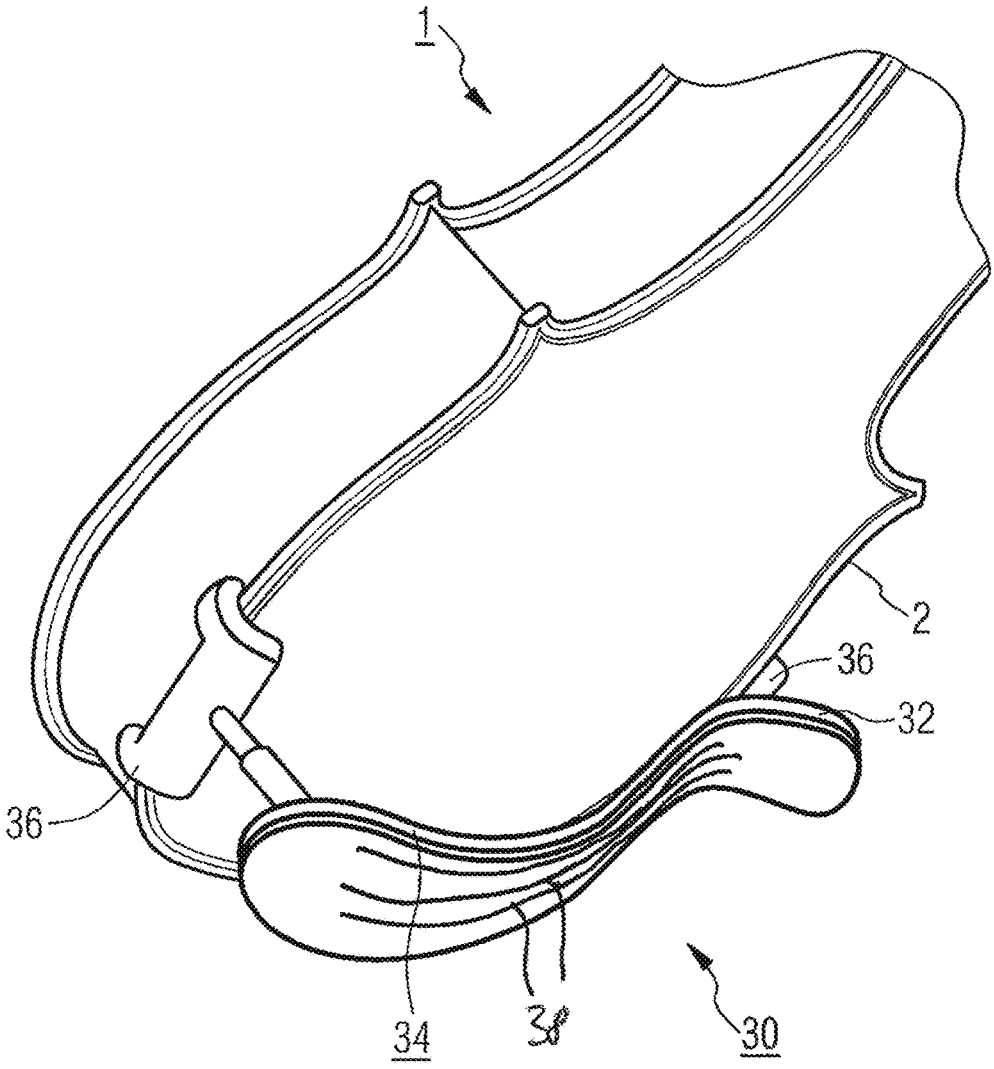
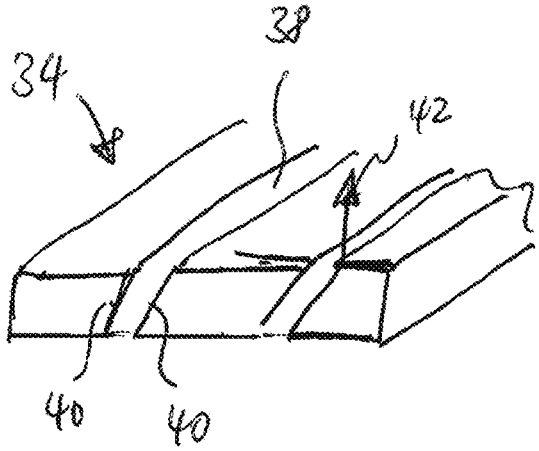
Fig. 4

SHOULDER REST

CROSS REFERENCE TO RELATED APPLICATIONS

This application claims priority to European Patent Application 20175545.1, filed May 19, 2020 and titled "Schulterstütze", which is hereby incorporated by reference in its entirety.

FIELD OF INVENTION

The invention relates to a shoulder rest for a stringed instrument, in particular for a violin or viola, with a support element for resting on the shoulder and/or chest of the player.

BACKGROUND OF INVENTION

Stringed instruments, especially violins and violas, are held at their body end between the musician's chin and shoulder when playing music. However, since the distance between the player's head and the shoulder area is usually greater than the thickness of the instrument, it is only possible for the musician to hold or pinch the instrument in a very uncomfortable position, so that—if it is possible to play the instrument at all—impairments to the quality of playing cannot be avoided. To counteract this, so-called chin rests and shoulder rests for violins and violas have been developed.

These shoulder rests are removably attached to the body of the instrument with a holding device and thus serve to make it more comfortable for the musician to hold the instrument. Basically, a shoulder rest is attached to a violin or the like and forms a support surface that rests on the musician's shoulder, with the instrument itself supported at a selected level. This depends in particular on the physique, especially the neck length, the shoulder shape and the violin position, of the musician. Such shoulder rests are known, for example, from prior patent publications EP 507 994 B1, U.S. Pat. No. 4,062,695, DE 100 07 834 A1, U.S. Pat. Nos. 7,265,284 and 7,488,877 B2.

The shoulder rests can be designed with a fixed base. However, such fixed base is usually shaped only insufficiently with respect to matching the musician's shoulder and thus individualized, so that usually some losses in terms of playing comfort and convenience have to be accepted. For comfort reasons, however, the fixed base can also be provided with a cushion at the bottom, which rests against the musician's shoulder when the instrument is played. Attached to both ends of the base are upwardly projecting support elements or carrying elements that support pivoting, forked end pieces. These can be attached to the side walls of the instrument body near the bottom of the body. To allow this type of shoulder rest to be firmly attached to the instrument, the bottom of the shoulder rest has a certain elasticity of its own, and this serves to generate a certain clamping force with which the fork-shaped end pieces grip the instrument. End pieces are also known in other embodiments in combination with the support elements, but they usually all grip the instrument with a certain clamping action.

To ensure high-quality sound and harmony with the instrument, such shoulder rests are usually made of plastic or synthetic material, but more recently also of wood or wood-based material, and their contours are at least approximately individualized to the shape of the player's body. Among other things, this is intended to ensure that the player can play the instrument particularly comfortably and harmoniously and without impairing his concentration or attention.

EP 27 17 255 A1 also discloses a shoulder rest of the type mentioned, with which a considerable improvement in the tonal properties of the ensemble of instrument and shoulder rest can be achieved. The support element of the shoulder rest is provided with a plurality of holes. Due to this design of the support element, the vibration behavior of the shoulder rest and the acoustic coupling to the vibration behavior of the instrument itself are particularly favorable and low in interference, so that overall a particularly high tonal quality can be achieved when playing the instrument.

SUMMARY OF INVENTION

It is now an object of the invention to provide a shoulder rest of the type mentioned above, with which an even further improved tonal quality of the ensemble of instrument and shoulder rest can be achieved.

According to the invention, this object is achieved in that the support element comprises a two-dimensionally extended base body which is segmented in such a way that it forms a plurality of separately vibrating elements.

The invention is based on the consideration that a particularly high-quality vibration behavior of the shoulder rest can be achieved by specifically designing the shoulder rest for the ability of a comparatively "free" vibration. To this end, the aim is to keep the coupled, jointly vibrating masses comparatively low. To make this possible, the support element should be subdivided into a plurality of elements or components that are acoustically not coupled to one another or coupled to one another as little as possible. For this purpose, a segmentation of the vibrating base body of the support element can be provided.

The desired segmentation of the support element can preferably be achieved by subdividing the basic body into elements which, viewed over the length of the support element, are separated from one another in substantial regions and are connected to one another only in the edge regions, for example only in end zones adjacent to the respective end of the basic body and having, for example, a length of at most 20% of the total length of the basic body. In particular, such segmentation can be achieved by providing opening slots in the base body of the support element so that the support element of the shoulder rest is provided with a number of longitudinally extending opening slots completely penetrating the support element in its thickness.

The opening slots can run in a straight line or also be curved or bent. Preferably, the opening slots should run in the longitudinal direction of the support element. The side edges of the support element can basically be straight; alternatively, however, the support element can be adapted to the shape of the users body for the purpose of high play quality and increased user-friendliness, and can be designed to be curved or twisted accordingly. In this case, "longitudinal direction" is to be understood as essentially a direction parallel to the side edges of the support element.

In order to achieve the desired decoupling or segmentation of the support element into a plurality of separately oscillating elements, the opening slots should be designed in the manner of mechanically separating elements completely or almost continuously penetrating, i.e., cutting through, the support element over its entire thickness.

The number and design of the opening slots are advantageously selected with regard to the desired improvement of the tonal properties. Depending on the design of the instrument and the other circumstances and requirements, they can be comparatively short to comparatively long, in particular between 10% and 80% of the length of the support element in its longitudinal direction, comparatively wide to comparatively narrow, in particular with a width between 0.5 and 3 mm, and provided and dimensioned in a suitable number, in particular between 1 and 5.

The opening slots can penetrate the base body of the support element essentially perpendicularly, i.e., with their side walls aligned parallel to the surface normal of the support element. Alternatively, the opening slots, or at least parts or regions thereof, can also be designed with side walls inclined relative to the surface normal of the support element. The angle of inclination, i.e., the angle between the respective side wall of the opening slot and the surface normal of the support element, is advantageously between 25° and 60°, very preferably about 45°.

In a very particularly preferred embodiment and for a particularly far-reaching improvement in the tonal properties of the shoulder rest, the support element is provided with a combination of the aforementioned opening slots and a number of through-holes already known per se from EP 27 17 255 A1. In such a combined arrangement, speaking from the user's or player's point of view, the holes bring about a certain "transparency" or lightness in terms of sound, whereas the slots provide "freedom". The holes are expediently arranged in so-called "hole tracks" which run along a corresponding contour line. Advantageously, the support element is thus provided with a plurality of holes arranged in a number of hole tracks each running in the longitudinal direction and completely penetrating the support element in its thickness.

In such a combination of hole pattern and opening slots, these can in principle be positioned and arranged independently of the hole pattern. Advantageously and in the sense of a particularly desirable tonal synergy between opening slots and hole pattern, however, these are positioned in combination with and relative to one another, whereby advantageously a number of the opening slots in each case in one of the hole tracks connect two holes adjacent to one another in the hole track. In a particularly preferred embodiment, the respective opening slot opens into the respective hole with a rounded side edge, so that it has a certain, possibly also comparatively slight, bend throughout at its side edges in the opening region. In this way, the contour of the opening slot in the junction area can be kept essentially free of corners, so that a particularly good redirection function can be achieved for the sound waves arriving in the longitudinal direction.

In a further particularly preferred embodiment, the holes form a hole pattern that particularly favors the tonal properties of the ensemble of instrument and shoulder rest. For this purpose, advantageously, a hole track formed by a number of primary holes is arranged centrally in the support element with respect to its width, and at least one hole track formed by a number of secondary holes is arranged eccentrically in the support element with respect to its width, the secondary holes being arranged in each case approximately in the middle between two adjacent primary holes, as viewed in the longitudinal direction of the support element. The support element is thus provided with a plurality of holes which form a specifically combined ensemble of primary and secondary holes, and which in their entirety are dimensioned and positioned for particularly favorable transmission of the sound within the base body. This particularly preferred positioning of the holes makes it possible in particular to take account of a plurality of actually divergent design objectives: on the one hand, particularly favorable guidance of the sound in the support element is made possible, while on the other hand the structural integrity of the support element itself can be kept particularly stable with regard to the weakenings caused by the holes.

For a particularly harmonious vibration behavior, the holes are advantageously chosen to be of equal size in terms of their diameter or area for one or both of these categories, i.e., primary holes on the one hand and/or secondary holes on the other. Surprisingly, it has also been found that particularly favorable vibration behavior can be achieved if the individual hole area of the primary holes is approximately four times the individual hole area of the secondary holes, i.e., if the hole size, defined for example by the clear width of a hole, of the primary holes is approximately twice the hole size of the secondary holes.

Particularly preferred is an arrangement in which, viewed in the longitudinal direction of the support element, two off-center secondary holes, preferably positioned mirror-symmetrically to the centerline of the support element, are provided between two successive primary holes. In such an arrangement, the above-mentioned choice of geometry, in which the hole size of the primary holes is approximately twice the hole size of the secondary holes, means that, viewed over the width of the support element, the cross-sectional proportion filled by the material of the base body is approximately as large in the region of the primary holes as in the region of the secondary holes, so that, viewed in the longitudinal direction of the support element, particularly high-quality sound conduction properties result. In particular, it is thereby achievable that the sound spectrum and the tone of the instrument appear high-quality and open, while the support element remains particularly easy to bend.

As has further surprisingly turned out, a particularly high tonal quality of the ensemble of instrument and shoulder rest is achievable in that the holes advantageously occupy a total area of at least 8%, preferably of at least 10%, and at most 30%, preferably of at most 20%, of the area of the support element. Particularly preferably, the holes occupy a total area of about 12.5% of the area of the support element. In alternative or additional advantageous further development, the holes are sharp-edged. Compared to holes with rounded edges, this achieves a particularly pleasing sound.

A particularly harmonious and high-quality sound image can also be achieved by contouring the holes or at least some of the holes in a particularly suitable manner. In particular, it is intended that the holes be executed in a contour that is not circularly round. Rather, some or all of the holes should advantageously have an elongated shape as viewed in the longitudinal direction of the support element, so that they each have a greater clear width as viewed in the longitudinal direction of the support element than in the transverse direction thereof. The longitudinally extended design of the holes can, in particular, be accompanied by a comparatively pointed contour in the area of impact of the sound waves, especially in the region where the opening slots open.

In a particularly advantageous further development, the contour of the primary holes comprises a number of almost straight, comparatively slightly curved contour segments. As a result, the holes can, for example, have a basic diamond-, diamond- or "eye"-shaped form which—viewed in the longitudinal direction of the support element—is comparatively pointed on its front and rear sides (apart from roundings) and has a certain, albeit comparatively slight, curvature on its side edges throughout.

Also surprisingly favorable for the sound image is when advantageously an uneven total number of the primary holes, preferably five, is provided.

As has further surprisingly turned out, for a particularly advantageous combination of sound properties on the one hand and comfort- and user-friendly (contour) properties on the other hand, the choice of suitable geometry parameters for the support element of the shoulder rest is significant. In a particularly advantageous embodiment, the cross-sectional area of the base body of the support element, relative to its longitudinal direction, should be at least 60 $mm^2$ (in particular when used as a support for a support element and/or when using hardened wood), preferably at least 75 $mm^2$, and at most 210 $mm^2$ (in particular when used with a thickness of 7 mm and a width of 3 cm), particularly preferably at most 150 $mm^2$. In particular, the cross-sectional area should be approximately uniform and change as little as possible along the longitudinal direction of the shoulder rest, since changes in the cross-sectional area seem to cause disturbances in the sound behavior.

A particularly preferred choice of material for the support element is wood, plastic, or synthetic material. In an advantageous embodiment, the support element therefore also has a thickness of at least 2 mm and at most 7 mm in the case of a design in wood, preferably of at least 3 mm and at most 6 mm, particularly preferably of at least 3.3 mm and at most 5 mm, and a thickness of at least 1.5 mm and at most 4.5 mm in the case of a design in plastic or synthetic material.

In order to ensure a particularly high level of comfort and thus particularly favorable playability under these boundary conditions, the width of the support element is also advantageously selected to be suitable. Advantageously, a width of the support element of at least 20 mm and at most 48 mm, particularly preferably of at least 22 mm and at most 30 mm, preferably of at least 24 mm and at most 28 mm, is provided.

The advantages achieved with the invention consist in particular in the fact that the segmented design of the support element, preferably with the opening slots, allows, soundwise, for a dissection or separation of the support body into a plurality of comparatively smaller elements, which create and convey a certain lightness in sound quality for the player. Particularly in the preferably provided combination with the hole pattern formed by additionally provided through-holes, a particularly high-quality sound behavior can thus be achieved overall.

BRIEF DESCRIPTION OF THE DRAWINGS

By way of example, an embodiment of the invention is explained in more detail with reference to drawings, in which:

FIG. 3 shows a perspective partial view of the violin with attached shoulder rest, FIG. 4 shows a cross-sectional view of a support element of the shoulder rest.

Identical parts are marked with the same reference numerals in all figures.

DETAILED DESCRIPTION OF THE DRAWINGS

Figure 1:
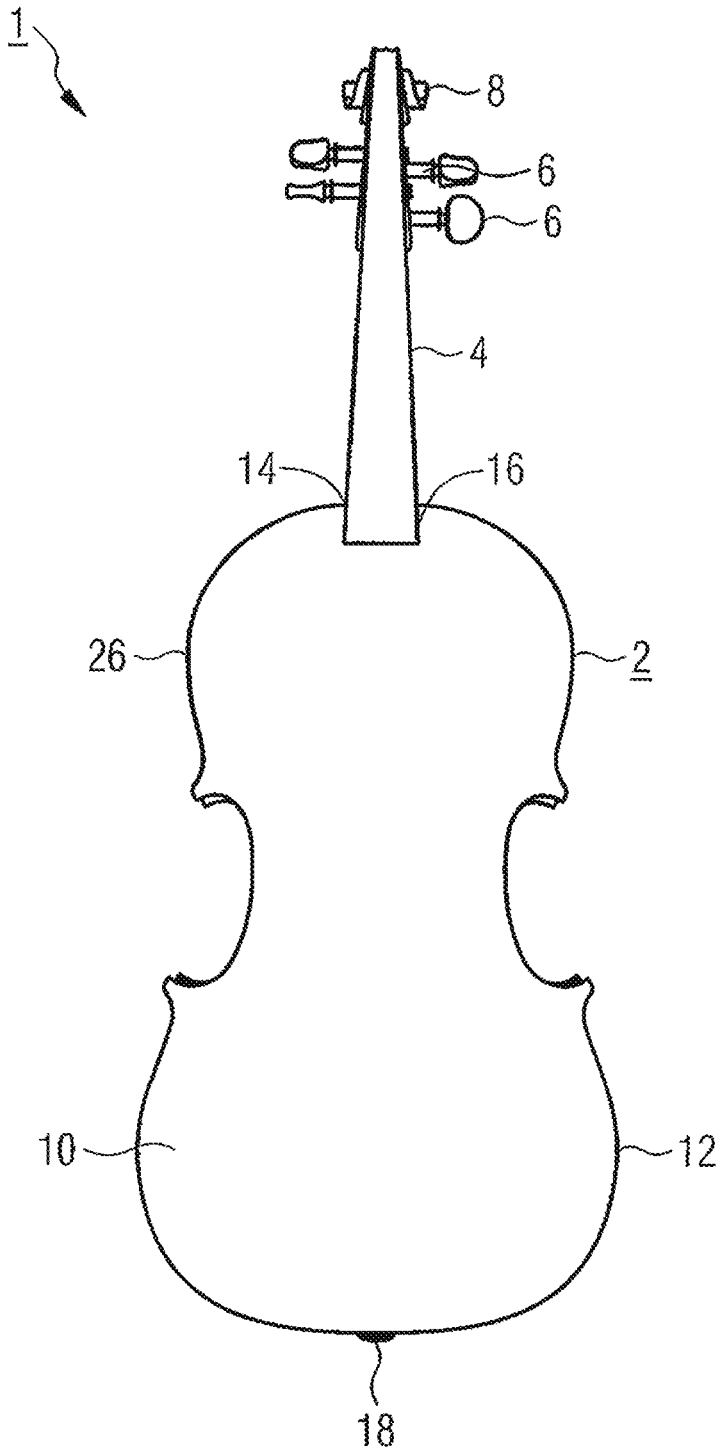
FIG. 1 shows a classical violin in bottom view.

A classical violin 1 according to FIG. 1 comprises a body 2, which forms the soundbox, a neck 4, on which a fingerboard is mounted, and a pegbox with pegs 6, the end of which is formed by a scroll 8. The body 2 has a body back 10 and a circumferential back edge 12. At the neck end 14 of the body 2, the neck 4 of the violin 1 is connected to the body 2 via the upper end block 16. Other blocks that serve to stabilize the violin 1 are incorporated into the body 2.

At the lower end block 18, the strings of the violin 1 are braced by means of a tailpiece end on the top of the violin 1. Therefore, the lower end block 18 is very stable and firmly incorporated into the body 2. The upper end block 16, which supports the neck 4 and the fingerboard, is also sturdy and firmly worked into the body 2. Nowadays, the upper end block 16 and the neck 4 are usually manufactured separately and glued together in order to fulfill the necessary wearing characteristics as well as sound and vibration characteristics.

Side panels, known as ribs 26, are attached to the side of the body bottom 10 in the area of the circumferential bottom edge 12, and a body top is then attached to these ribs 26 opposite the body bottom. These parts essentially form the body 2, which is the resonance chamber of the violin 1, and are stabilized with the help of the so-called outer blocks and the upper and lower end blocks 16, 18.

Figure 2:
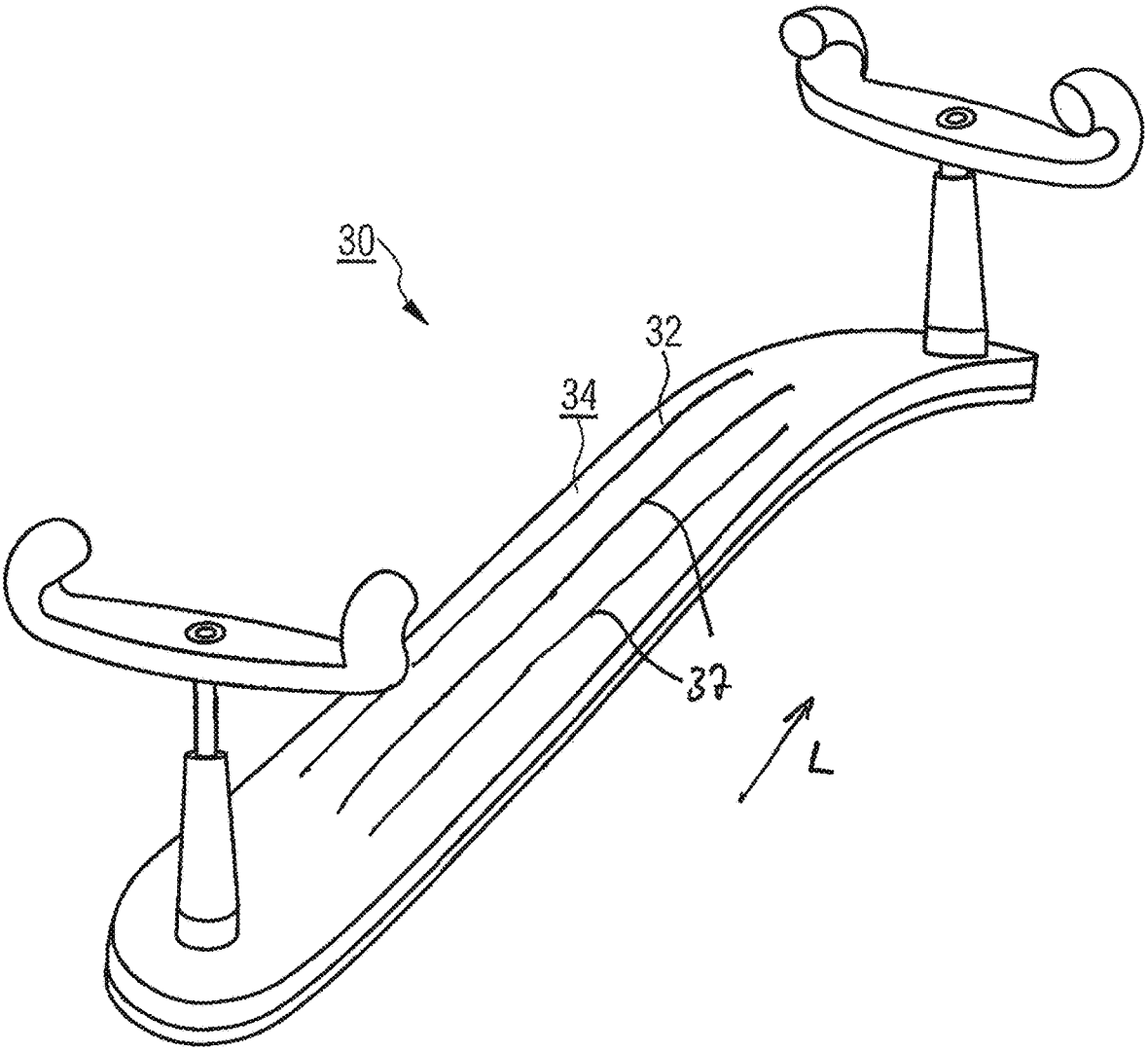
FIG. 2 shows a shoulder rest for the violin according to FIG. 1.

In order to enable the musician to maintain a comfortable posture while playing the violin 1 while maintaining a high sound quality, a shoulder rest 30 is provided, as shown in FIG. 2 as a separate component and in FIG. 3 in an assembled state attached to the body 2 of the violin 1. The shoulder rest 30 comprises a flat support element 32 which extends in a longitudinal direction L and is intended to be placed on the shoulder and/or chest of the player, and which can be attached to the body 2 of the violin 1, and in particular to the circumferential base edge 12, via clamping units 36 arranged at the ends. In the embodiment shown, the shoulder rest 30 can thus be attached directly to the body 2 of the violin 1 via the clamping units 36; alternatively, however, the additional use of an adapter piece between the shoulder rest 30 and the body 2 could also be provided.

The shoulder rest 30 is designed for a particularly high tonal quality of the ensemble of violin 1 and shoulder rest 30. Particular account is taken of the realization that the shoulder rest 30, which is attached to the body 2 and mechanically connected to it at the holding points, could have an influence on the vibration spectrum of the body 2 as a whole and in particular on its nodal points and impair the "free" unfolding of the sound spectrum. In order to limit or, if possible, completely avoid these inherently undesirable effects, the shoulder rest 30 is designed to limit jointly vibrating masses. This is achieved by segmenting the planar extended base body 34 of the support element 32 in such a way that it forms a plurality of separately vibrating elements. This segmentation could be achieved in various ways; in the embodiment shown considered to be particularly preferred, the support element 32 of the shoulder rest 30 is provided for this purpose with a number of opening slots 38 extending in the longitudinal direction L and completely penetrating the support element 32 in its thickness.

The opening slots 38 are suitably selected with regard to the intended improvement of the tonal properties of the violin 1 and are adapted thereto. In the embodiment shown, they are designed to be comparatively long, and they have a length of about 70% of the length of the support element 32. Depending on the particular circumstances and requirements, they can alternatively also be comparatively short to comparatively long, in particular between 10% and 80% of the length of the support element in its longitudinal direction, comparatively wide to comparatively narrow, in particular with a width between 0.5 and 3 mm, and provided and dimensioned in a suitable number, in particular between 1 and 5.

The opening slots 38 can penetrate the base body 34 of the support element 32 substantially perpendicularly. i.e., with their side walls 40 aligned parallel to the surface normal of the support element 32. In an alternative, preferred embodiment, as can be seen from the sectional representation in FIG. 4, the opening slots 38, or at least parts or regions thereof, are however designed with side walls 40 inclined with respect to the surface normal of the support element 32 indicated by the arrow 42. The angle of inclination, i.e., the angle between the respective side wall of the opening slot and the surface normal of the support element, is advantageously between 25° and 60°, very preferably about 45°. Such an inclination of the side edges of the opening slots is achieved.

Figure 5:
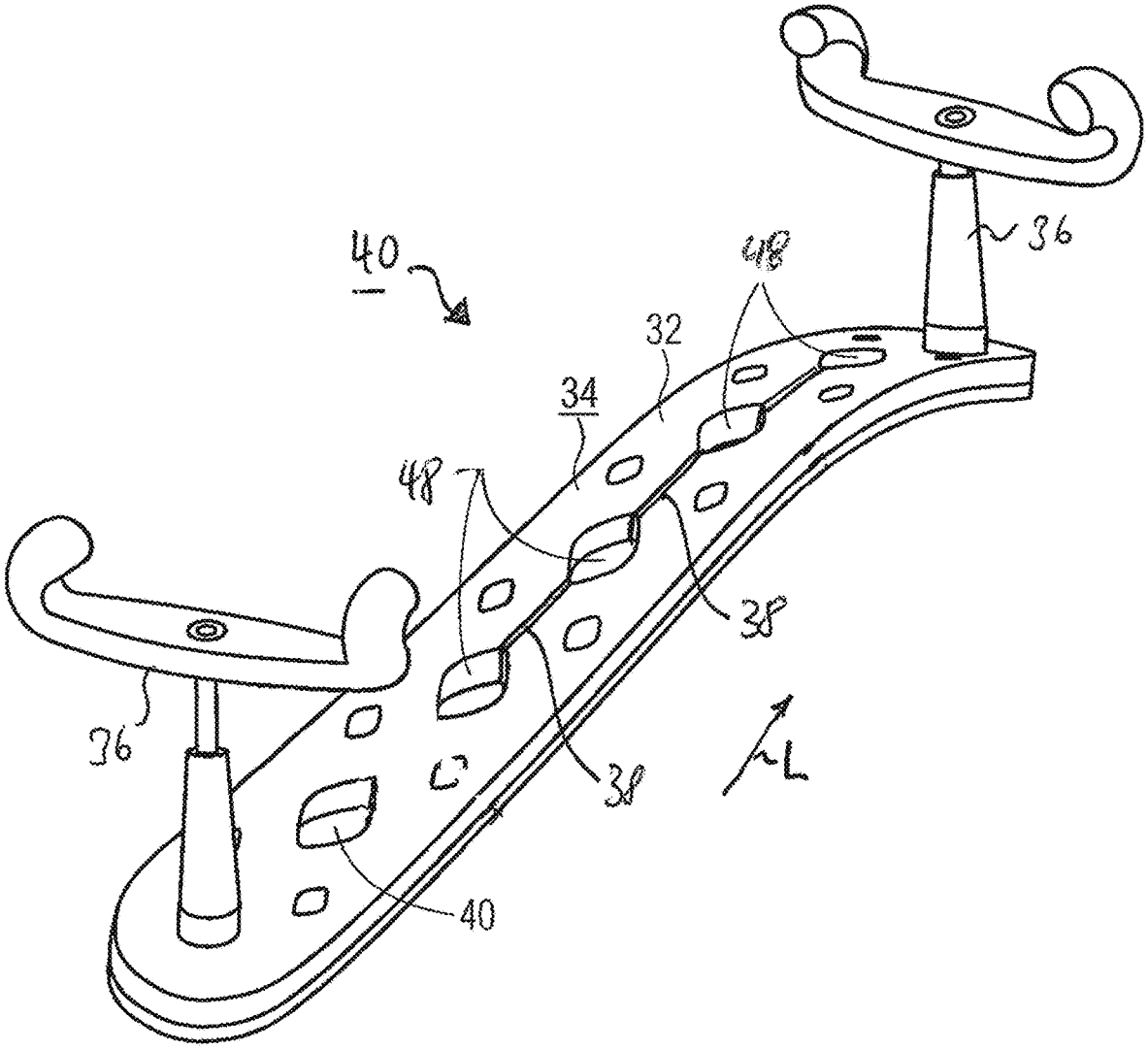
FIG. 5 shows an alternative design of a shoulder rest.
Figure 6A:
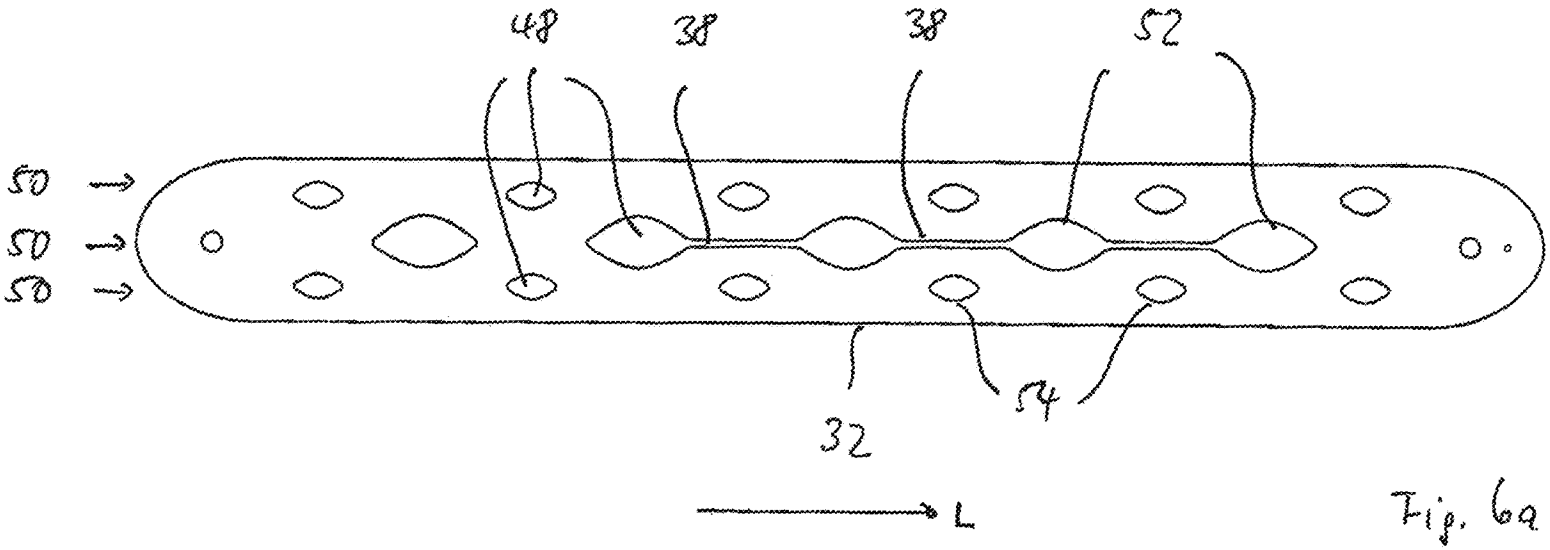
FIGS. 6A and 6B show the base body of a support element of the shoulder rest according to FIG. 5 in plan view.
Figure 6B:
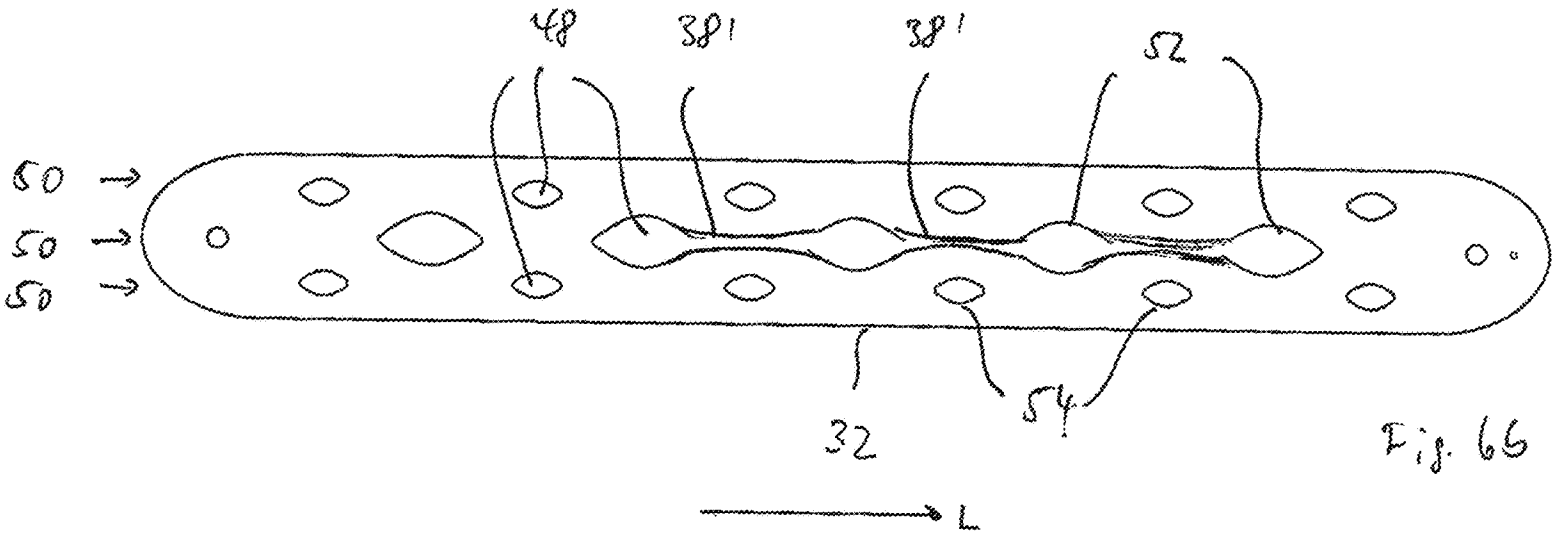

An alternative, particularly preferred embodiment of a shoulder rest 40 is shown in FIG. 5, where FIGS. 6A and 6B each shows a top view of the support element 32 of the shoulder rest 40. Just as in the shoulder rest 30 according to FIG. 2, the support element 32 is here provided with a number of opening slots 38 improving the tonal properties of the ensemble of violin 1 and shoulder rest 40. In addition, however, in the embodiment example according to FIGS. 5, 6A, and 6B, the support element 32 also has a plurality of holes 48 completely penetrating the support element 32 in its thickness, which further improve the vibration and thus the tonal behavior of the shoulder rest 40, especially in combination with the opening slots 38.

The holes 48 are arranged in respective hole tracks 50 extending in the longitudinal direction L of the support element 32, as is clear in particular from the plan view shown in FIGS. 6A and 6B. In principle, the opening slots 38 could thereby be positioned independently of the hole pattern formed by the holes 48, but in the embodiment shown the holes 48 are positioned in combination with the opening slots 38 in the sense of a synergistic effect for improving the tonal properties. As can be seen particularly clearly from the representation of the shoulder rest 40 in plan view in FIGS. 6A and 6B, the opening slots 38 are positioned in this case in such a way that one of the opening slots 38 in each case in one of the hole tracks 50 connects two holes 48 adjacent to one another in the respective hole track 50. In particular, the opening slots 38 run in the respective hole track 50. In the embodiment example shown, only the primary holes 52 arranged in the central hole track 50 are connected via the opening slots 38; however, this can of course also be provided for the secondary holes 54 in the off-center hole tracks 50, or further opening slots 38 independent of the hole tracks 50 can be provided.

In the variant shown in FIG. 6B, the opening slots are not designed in a straight line but in a curved contour. As a result, the respective opening slot 38 opens into the respective hole 48 with a rounded side edge, so that it has a certain, possibly also comparatively slight, bend throughout in the confluence area at its side edges in each case.

The holes 48 also form a hole pattern which is regarded as particularly favorable, in which a specifically combined ensemble of primary holes 52 on the one hand and secondary holes 54 on the other hand is provided. In this case, a hole track 50 formed by a number of primary holes 52 is arranged centrally in the support element 32 with respect to the width thereof, and at least one hole track 50 formed by a number of secondary holes 54 is arranged eccentrically in the support element 32 with respect to the width thereof, the secondary holes 54 each being arranged approximately in the middle between two adjacent primary holes 52, as viewed in the longitudinal direction of the support element 32. This arrangement of the holes 48 in their entirety makes it possible to achieve a particularly favorable transmission of the sound within the base body 34.

In this connection, a total of five primary holes 52, relative to the width of the support element 32, are arranged centrally in the latter and the secondary holes 54, likewise relative to the width of the support element 32, are arranged off-center in pairs symmetrically relative to the center of the support element 32 in the latter and, viewed in the longitudinal direction thereof, in each case approximately in the center between two adjacent primary holes 52. This positioning of the holes 48 makes it possible in particular to take account of a plurality of actually divergent design objectives: on the one hand, particularly favorable guidance of the sound in the support element 32 is made possible, while on the other hand the structural integrity of the support element 32 itself can be kept particularly stable with respect to the weakenings caused by the holes 48.

The primary holes 52 are selected to be equal in size to each other, as are the secondary holes 54 to each other. In addition, the individual hole area of the primary holes 52 is approximately four times the individual hole area of the secondary holes 54, i.e., the hole size, for example defined by the clear width of a hole 48, of the primary holes 52 is approximately twice the hole size of the secondary holes 54. This choice of geometry ensures that, viewed over the width of the support element 32, the cross-sectional proportion filled by the wood material in the region of the primary holes 52 is approximately as large as in the region of the secondary holes 54, so that, viewed in the longitudinal direction of the support element 32, particularly high-quality sound conduction properties result. In the embodiment example, the holes 48 occupy a total area of about 12.5% of the area of the support element 32. In general, it has been found that comparatively smaller holes 48 tend to produce a more muffled sound, whereas comparatively larger holes 48 tend to produce a more open sound, so that the selected hole size and thus also its area proportion of the total area of the support element 32 can also be suitably selected with respect to the desired sound behavior and, if necessary, also with respect to the material (wood) intended for use.

In addition, the holes 48 are designed with sharp edges, since, compared to holes with rounded edges, a particularly pleasing sound pattern can be achieved thereby.

Moreover, as can be seen particularly clearly from the plan view in FIGS. 6A and 6B, the holes 48 are not round, but are contoured in an elongated shape as viewed in the longitudinal direction L of the support element 32. Thus, viewed in the longitudinal direction L of the support element 32, they each have a larger clear width than in the transverse direction thereof.

The support element 32 can be provided on its rear side, i.e., on its side intended for resting on the player's shoulder, with a buffer element of comparatively elastic or soft material, for example a rubber buffer or the like. This buffer element may thereby also have holes which preferably correspond to the holes 48 and are arranged in position and dimension to match the latter. This provides completely continuous holes for the composite body consisting of the support element and the buffer element, which also ensure a special tonal quality of the composite body.

Figure 7:
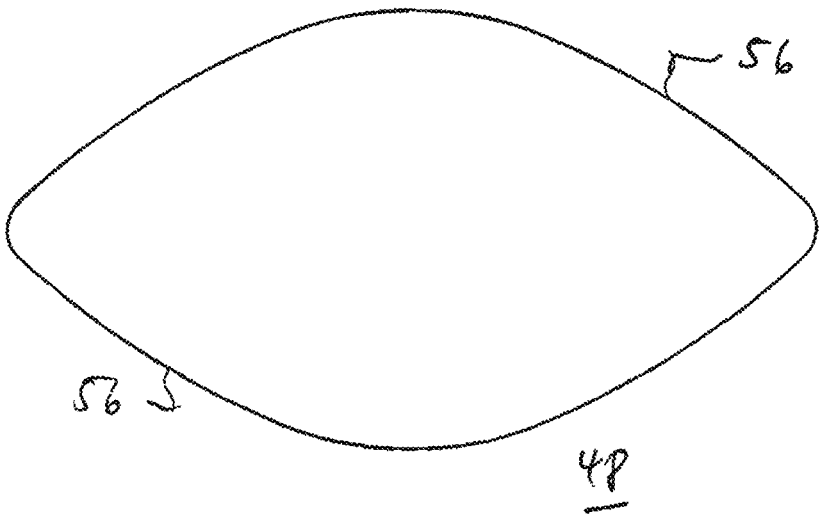
FIG. 7 shows a hole cross section.

As can also be seen from the plan view in FIGS. 6A and 6B and, in particular, from the contour representation of the holes 48 in plan view in FIG. 7, the contour of the primary holes 52, like that of the secondary holes 54, comprises a number of contour segments 56 extending almost rectilinearly but nevertheless with a comparatively slight continuous bend, so that the holes 48 have essentially a diamond-, eye- or diamond-shaped basic form. The relationship between the clear longitudinal width and the clear transverse width of the holes 48 may vary, particularly as a function of the geometry parameters of the shoulder rest as a whole, such as its overall length and/or overall width.

LIST OF REFERENCE NUMERALS

1 Violin
2 Body
4 Neck
6 Peg
8 Scroll
1 Body bottom
12 Back edge
14 neck ends
16, 18 End block
20, 22 Outside block
26 Ribs
30, 40 Shoulder rest
32 Support element
34 Base body
36 Clamping unit
38 Opening slot
48 Holes
50 Hole track
52 Primary holes
54 Secondary holes
56 Contour segment
L Longitudinal direction

What is claimed:

1. A shoulder rest for a stringed instrument comprising a support element extending in a longitudinal direction for resting on a shoulder or chest of a player, wherein the support element comprises a two-dimensionally extended base body segmented in such a way that it forms a plurality of separately vibrating elements, and wherein the support element comprises a number of opening slots preferably extending in the longitudinal direction and completely penetrating the support element in its thickness.

2. The shoulder rest of claim 1, wherein the support element comprises a plurality of holes arranged in a number of hole tracks each extending in the longitudinal direction, said holes completely penetrating the support element in its thickness.

3. The shoulder rest of claim 2, wherein a number of the opening slots each in one of the hole tracks connect two holes adjacent to each other in the hole track.

4. The shoulder rest of claim 3, wherein each respective opening slot opens into its respective hole with a rounded side edge.

5. The shoulder rest of claim 2, in which a hole track formed by a number of primary holes is arranged centrally in the support element relative to the width thereof and at least one hole track formed by a number of secondary holes is arranged eccentrically in the support element relative to the width thereof, wherein the secondary holes, viewed in the longitudinal direction of the support element, are each arranged approximately in the middle between two adjacent primary holes.

6. The shoulder rest of claim 5, wherein the primary holes are equal in size.

7. The shoulder rest of claim 5, wherein the secondary holes are equal in size.

8. The shoulder rest of claim 5, wherein the primary holes have a hole area approximately four times a hole area of the secondary holes.

9. The shoulder rest of claim 5, wherein the primary holes and secondary holes collectively occupy a total area of at least 8% and at most 30% of an area of the support element.

10. The shoulder rest of claim 5, wherein the holes each have a larger clear width as viewed in the longitudinal direction of the support element than in the transverse direction thereof.

11. The shoulder rest of claim 5, wherein a contour of the primary holes comprises a number of curved contour segments.

12. The shoulder rest of claim 5, wherein the number of primary holes is odd.

13. The shoulder rest of claim 1, wherein the support element has, with respect to its longitudinal direction, a cross-sectional area of at least 60 $mm^2$ and at most 210 $mm^2$.

14. The shoulder rest of claim 1, wherein the support element has a width of at least 20 mm and at most 48 mm.

* * * * *